US011008767B1

(12) United States Patent
Mohammad

(10) Patent No.: US 11,008,767 B1
(45) Date of Patent: May 18, 2021

(54) AUTOMATED BUILDING FACADE CLEANER

(71) Applicant: Ahmad M. Z. Mohammad, Safat (KW)

(72) Inventor: Ahmad M. Z. Mohammad, Safat (KW)

( * ) Notice: Subject to any disclaimer, the term of this patent is extended or adjusted under 35 U.S.C. 154(b) by 0 days.

(21) Appl. No.: 16/795,517

(22) Filed: Feb. 19, 2020

(51) Int. Cl.
*E04G 23/00* (2006.01)
*A47L 1/02* (2006.01)
*A47L 7/00* (2006.01)

(52) U.S. Cl.
CPC ..... *E04G 23/004* (2013.01); *A47L 1/02* (2013.01); *A47L 7/0014* (2013.01)

(58) Field of Classification Search
CPC ..... A47L 1/02; A47L 7/0009; A47L 7/0014; A47L 9/0626; A47L 11/408; E04G 23/004
USPC ..... 15/314, 315, 301, 302, 319, 320, 322, 15/103
See application file for complete search history.

(56) References Cited

U.S. PATENT DOCUMENTS 4,025,984 A * 5/1977 Hoener, Jr. ..... A47L 1/02 15/302
4,136,419 A * 1/1979 Hetman ..... A47L 1/02 15/302
4,198,724 A * 4/1980 Fisher ..... A47L 1/02 15/103
4,521,935 A * 6/1985 Johnston ..... A47L 11/34 15/322
4,797,969 A * 1/1989 Caduff ..... A47L 1/02 15/103
4,879,784 A * 11/1989 Shero ..... A47L 9/02 15/322
4,955,924 A 9/1990 Gorman
6,170,109 B1 * 1/2001 Jesadanont ..... A47L 1/02 15/103
7,503,091 B2 3/2009 White, Jr. et al.
7,784,147 B2 * 8/2010 Burkholder ..... A63D 5/10 15/320
7,823,242 B2 11/2010 Gorman
9,487,962 B2 11/2016 Falk
9,505,590 B2 * 11/2016 Chen ..... E04G 3/34
2003/0106176 A1 6/2003 Wang
2011/0180098 A1 6/2011 Lange et al.
2016/0017619 A1 * 1/2016 Pitbladdo ..... A47L 1/02 134/180
2017/0188762 A1 * 7/2017 Wilkes ..... A47L 1/02
(Continued)

FOREIGN PATENT DOCUMENTS

CN 102908110 A 2/2013

*Primary Examiner* — Monica S Carter
*Assistant Examiner* — Marcel T Dion
(74) *Attorney, Agent, or Firm* — Nath, Goldberg & Meyer; Richard C. Litman

(57) ABSTRACT

An automated building façade cleaner includes a cleaning module attached to multiple guide cables. The cleaning module can be moved along a height of the building by hoists secured to a top of the building. A cleaning fluid is fed into the cleaning module by a fluid supply module. The liquid is sprayed onto the building from nozzles in the cleaning module. A suction line, connected to a suction module, provides suction within the cleaning module for collecting loose water and dirt produced by the cleaning module. The building façade cleaner may be automated to operate without human interaction.

4 Claims, 5 Drawing Sheets

(56) References Cited

U.S. PATENT DOCUMENTS

2019/0320859 A1* 10/2019 Bofill ..... E04G 23/002
2019/0321868 A1* 10/2019 Emrem ..... B08B 7/04

* cited by examiner

AUTOMATED BUILDING FACADE CLEANER

BACKGROUND OF THE INVENTION

1. Field of the Invention

The disclosure of the present application relates generally to devices for cleaning an exterior of a building, and more particularly, to an automated building cleaning system which automatically dispenses fluid and cleans an external surface of the building.

2. Description of the Related Art

With the increasing number of skyscrapers and multi-story buildings in cities around the world, there is an increased demand for sophisticated and efficient systems for cleaning the exterior of these buildings. The exterior of such buildings must be cleaned regularly due to pollution, contamination, and weather conditions.

Traditional methods of cleaning the exterior of multi-story buildings involve hauling heavy machines on cranes or manually washing portions of a building façade at a time. These traditional methods raise concerns of cost, noise, safety, privacy of occupants in the building, and time consumed in every round of operation.

Accordingly, an automated building façade cleaner overcoming the aforementioned problems is desired.

SUMMARY OF THE INVENTION

The automated building façade cleaner includes a cleaning module attached to multiple guide cables which are configured to retractably extend from a roof of a building and along a side thereof. The cleaning module can be moved upwards and downwards along the side surface of the building by hoists. The hoists can be positioned on the roof of the building. A fluid supply module can supply cleaning fluid to the cleaning module. The cleaning fluid is sprayed onto the surface of the building through nozzles in the cleaning module. A suction line provides suction for collecting loose water and dirt produced by the cleaning module and directs the collected material to a suction module. An upper row of suction mouths retrieves loose dirt and dust dislodged by a brush on the cleaning module, and a lower row of suction mouths retrieves loose fluid and dirt produced by the fluid spray.

In use, the hoists, fluid supply module, and suction module are positioned on the roof of the building. The cleaning module can be lowered to a lower portion of a building façade to clean the façade as it is pulled upwards by the hoists. The building façade cleaner may be fully automated to provide a full cleaning without human interaction or partially automated to require minimal human interaction.

These and other features will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
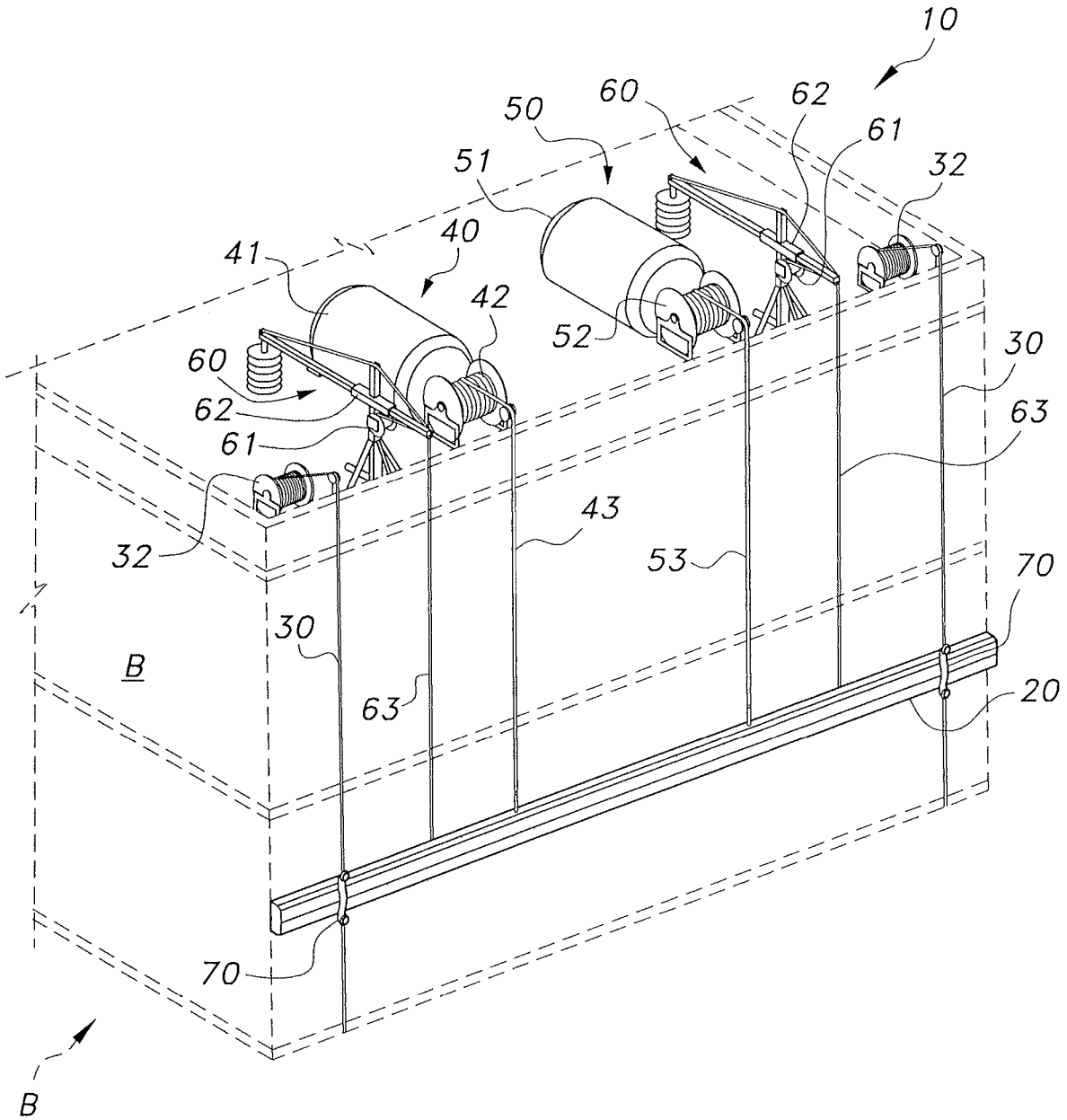
FIG. 1 is an environmental, perspective view of an embodiment of a building façade cleaner installed on a building.

FIG. 1 shows the automated building façade cleaner 10 for cleaning an exterior surface or façade of a building B. The automated building façade cleaner 10 includes a cleaning module 20 attached to multiple guide cables 30 which are configured to retractably extend from tensioners 32 secured to a roof of a building. The cleaning module 20 can be moved upwards and downwards along the side surface of the building B by operation of hoists 60. A cleaning fluid can be supplied to the cleaning module 20 from a fluid supply module 40. The cleaning fluid is sprayed onto the building B from nozzles 47 in the cleaning module 20, A suction line 53, connected to a suction module 50, provides suction for collecting the loose water and dirt produced by the cleaning module 20 during cleaning. An upper row of suction mouths 57*a*, 57*b* connected to suction line 53 retrieves loose dirt and dust dislodged by a brush on the cleaning module. A lower row of suction mouths 57*a*, 57*b* connected to suction line 53 retrieves residue fluid and dirt produced by the fluid spray.

The tensioners 32 may be positioned on the roof of the building and may be adjusted to maintain proper tension in the guide cables 30 for guiding the cleaning module 20 along the surface of the building. In some embodiments, each tensioner 32 may include a rotatable spool 42 that can be locked when its respective guide cable 30 is properly tensioned.

The hoists 60 can be positioned on the roof to raise or lower the cleaning module by pulling in or releasing lifting cables 63 to move the cleaning module 20 along the side surface of the building. In some embodiments, as shown in FIG. 1, the hoists 60 may include a crane 62 and a motor operated spool 61.

A fluid line 43 may extend from the fluid supply module 40 to the cleaning module 20. The fluid line 43 may supply fluid to be dispensed by the cleaning module 20 during the cleaning process. A motor operated spool 42 may reel in or release the fluid line 43 as needed while the cleaning module 20 moves along a surface of the building B. The cleaning module 20 may include a fluid tank 41 having a heater for providing hot water or steam to the cleaning module 20, A pump may be used for providing increased fluid pressure in the fluid line 43.

Figure 2:
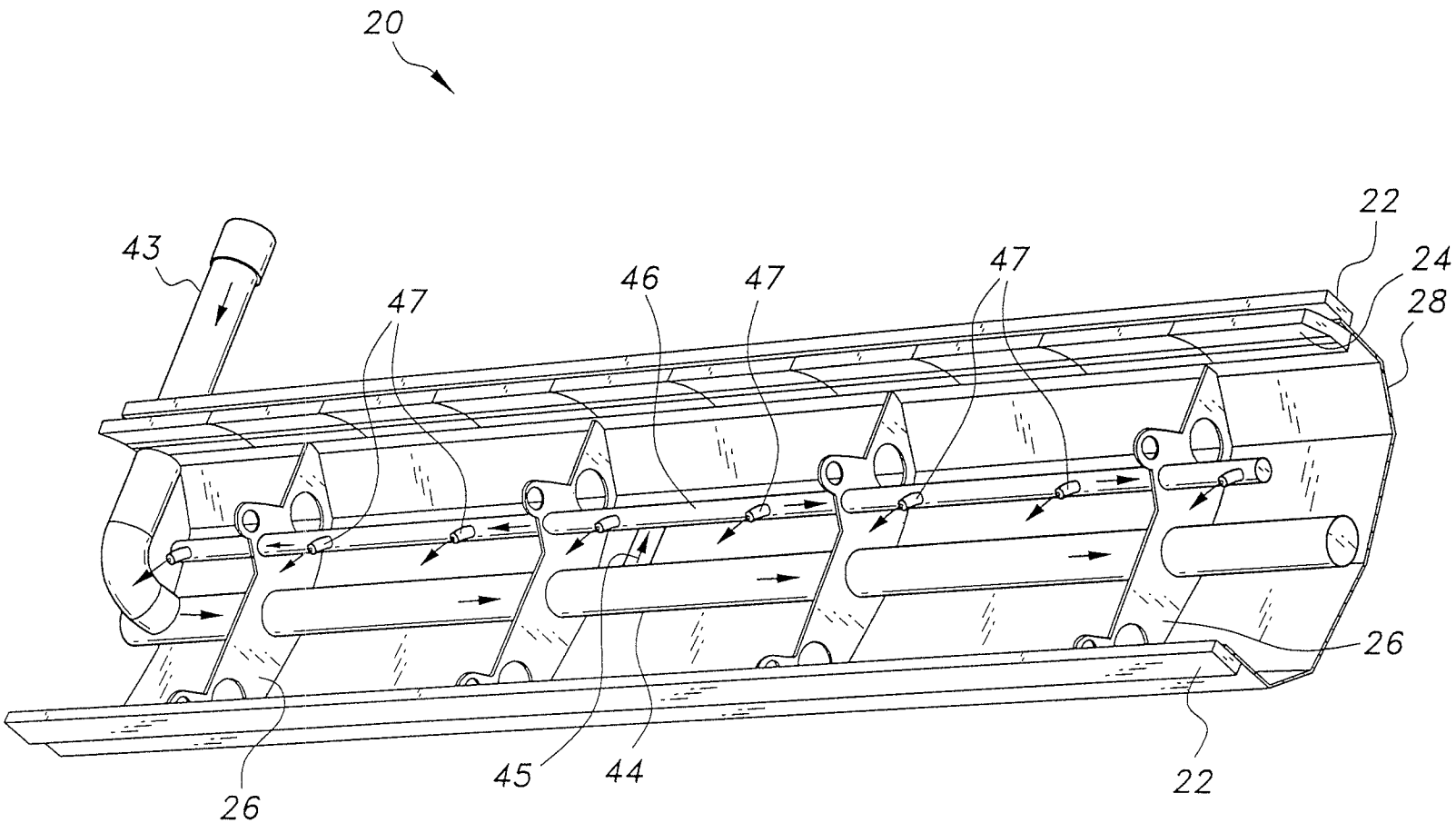
FIG. 2 is a perspective view of an embodiment of a cleaning module for use with the building façade cleaner of FIG. 1 with the suction mouths and conduits removed for explanatory purposes.

The suction line 53 may provide suction to suction mouths 57*a*, 57*b* in the cleaning module 20. A motor operated spool 52 may reel in or release suction line 53 as the cleaning module 20 is moved along the facade of the building. The suction module 50 may include a vacuum pump, a collection tank 51, and a dust separator or filter for retaining dust in the collection tank 51, FIG. 2 shows an embodiment of the cleaning module 20 without the suction mouths 57*a*, 57*b* and conduits 54*a*, 54*b*, 55*a*, 55*b*, 56*a*, 56*b*. The fluid nozzles 47 and delivery conduits 44, 45, 46 are shown. The fluid line 43, which delivers fluid from the fluid supply module 40, may extend into the cleaning module 20 and feed directly into a primary fluid conduit 44. The primary fluid conduit 44 may extend across a length of the cleaning module 20. A smaller diameter nozzle conduit 46 may be connected to the primary fluid conduit 44 by one or more connector conduits 45. The nozzles 47, configured to spray fluid onto a building surface, may be equally spaced apart along a length of the nozzle conduit 46. Fluid may be directed to the nozzle conduit 46 through the connector conduit 45 or through multiple connector lines extending between the nozzle conduit 46 and a larger diameter primary fluid conduit 44. This arrangement can facilitate more consistent pressure at each nozzle 47 and mitigate the progressive pressure loss along a length of the nozzle conduit 46 resulting from the pressure loss at each nozzle 47, The conduits 44, 46 may be secured to the body 28 by veins 26.

Figure 3:
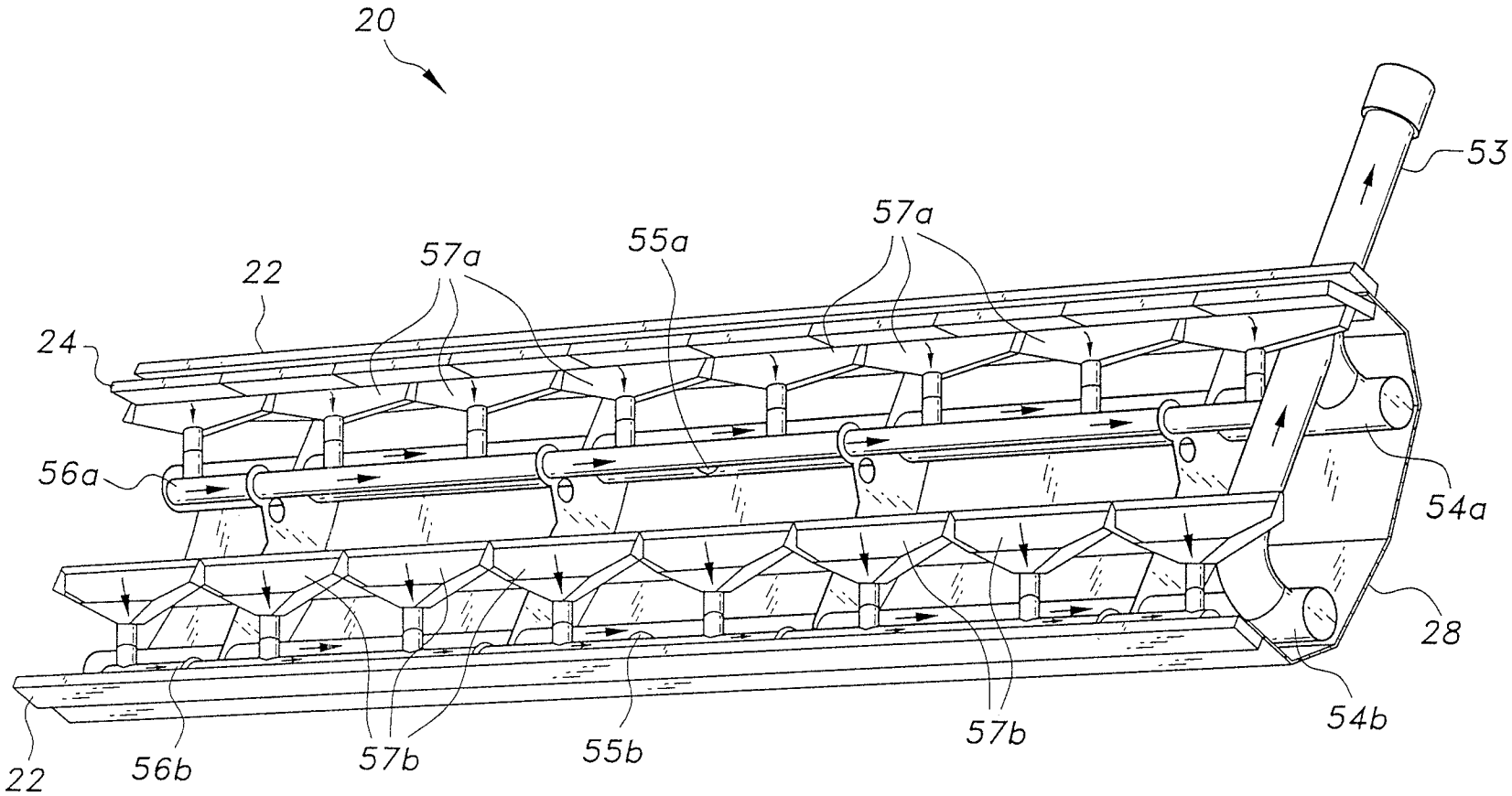
FIG. 3 is a perspective view of an embodiment of the cleaning module for use with the building façade cleaner of FIG. 1 with the fluid conduits and nozzles removed for explanatory purposes.

FIG. 3 shows an embodiment of the cleaning module 20 without the fluid nozzles 47 and conduits 45, 46. The suction mouths 57*a*, 57*b* and conduits 54*a*, 54*b*, 55*a*, 55*b*, 56*a*, 56*h* are shown in FIG. 3. The suction line 53, which provides suction from the suction module 50, may extend into the body 28 of the cleaning module. The suction line 53 may feed directly into an upper suction conduit 54*a* and a lower suction conduit 54*b*. The upper suction conduit 54*a* may provide suction to upper mouth conduit 56*a* through one or more connector conduits 55*a*. The lower suction conduit 54*b* may provide suction to a lower mouth conduit 56*b* through one or more connector conduits 55*b*. Upper and lower suction mouths 57*a*, 57*b* may be equally spaced apart along a length of the upper and lower mouth conduits 56*a*, 56*b*, respectively. Dirt or debris on the building façade can be suctioned into the mouth conduits 56*a*, 56*b* and pulled into connector conduits 55*a*, 55*b* or multiple connector conduits extending along a length of the mouth conduits 56*a*, 56*b* to larger diameter suction supply conduits 54*a*, 54*b*. The conduits 54*a*, 54*b*, 56*a*, 56*b* may be secured to the body 28 be veins 26.

Figure 4:
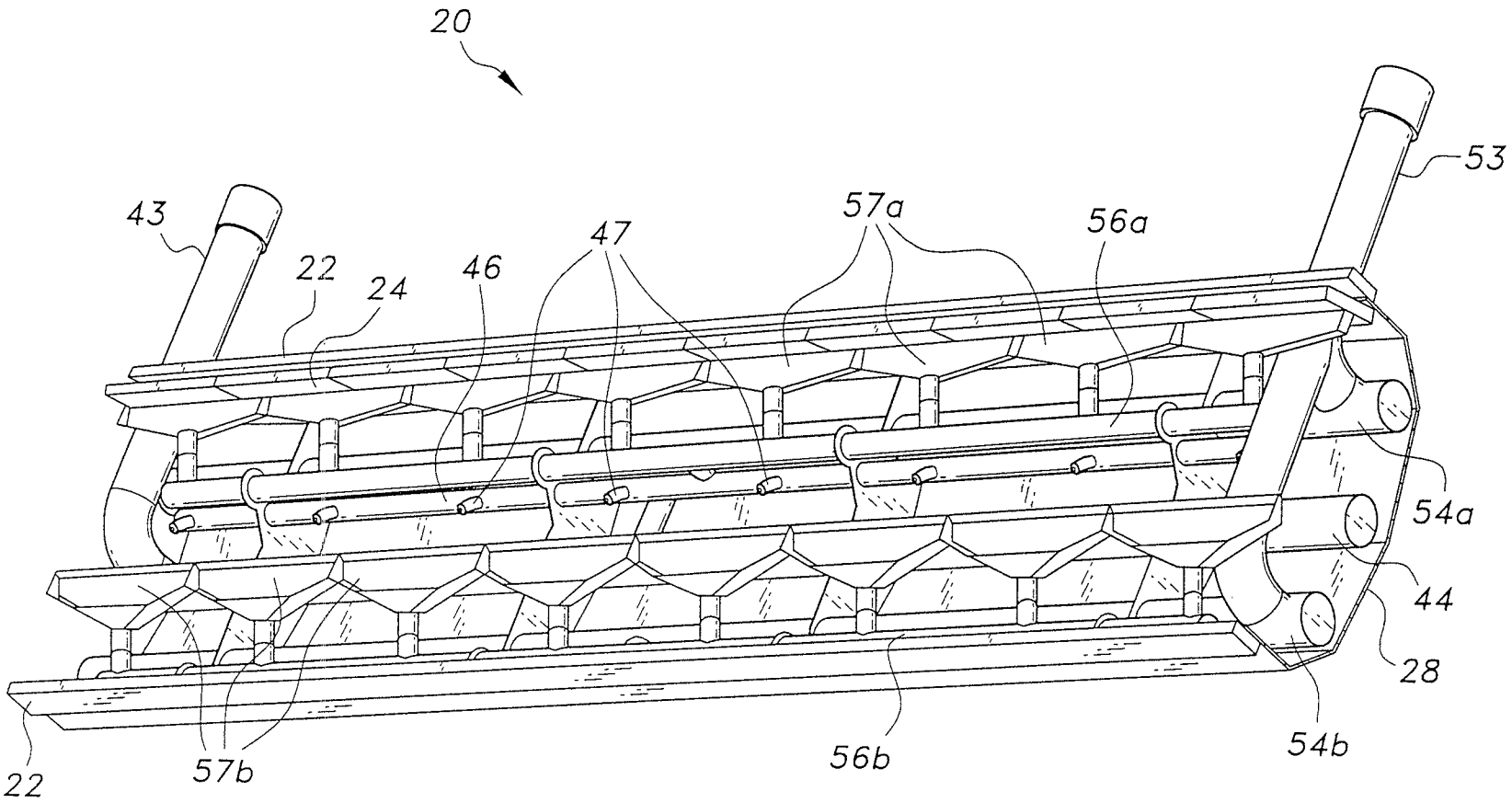
FIG. 4 is a perspective view of an embodiment of the cleaning module for use with the building façade cleaner of FIG. 1.

FIG. 4 shows a complete cleaning module 20 with the suction mouths 57*a*, 57*b* and conduits 54*a*, 54*b*, 56*a*, 56*b*, the fluids nozzles 47, and conduits 44, 46. The cleaning module 20 may include upper and lower bumpers 22 to protect the building from contact with the cleaning module 20. The bumpers 22 may be made from a material softer than the façade of the building, such as rubber, or other relatively soft polymers. A brush 24 may be located between the upper bumper 22 and the upper suction mouths 57*a*. The brush 24 may be positioned to brush the façade of the building as the cleaning module 20 moves along the surface of the building.

In some embodiments, the cleaning module may be expanded by lengthening the primary fluid conduits 44, nozzle conduits 46, suction conduits 54*a*, 54*b*, and mouth conduits 56*a*, 56*b*. For example, multiple connector conduits 45, 55*a*, 55*h* may be added for connecting the primary fluid conduits 44 and the suction conduits 54*a*, 54*h* with the nozzle conduits 46 and mouth conduits 56*a*, 56*b*. In some embodiments, modular cleaning modules may be provided, allowing for a customizable length based on a size of the façade being cleaned. The primary fluid conduits 44, suction conduits 54*a*, 54*b*, nozzle conduits 46, and mouth conduits 56*a*, 56*b* may be connected in series to adjacent modules. The constructed cleaning module 20 may then only require a single fluid line 43 and suction line 53. Alternatively, multiple façade cleaners 10 may be provided side-by-side to extend cleaning coverage.

Figure 5:
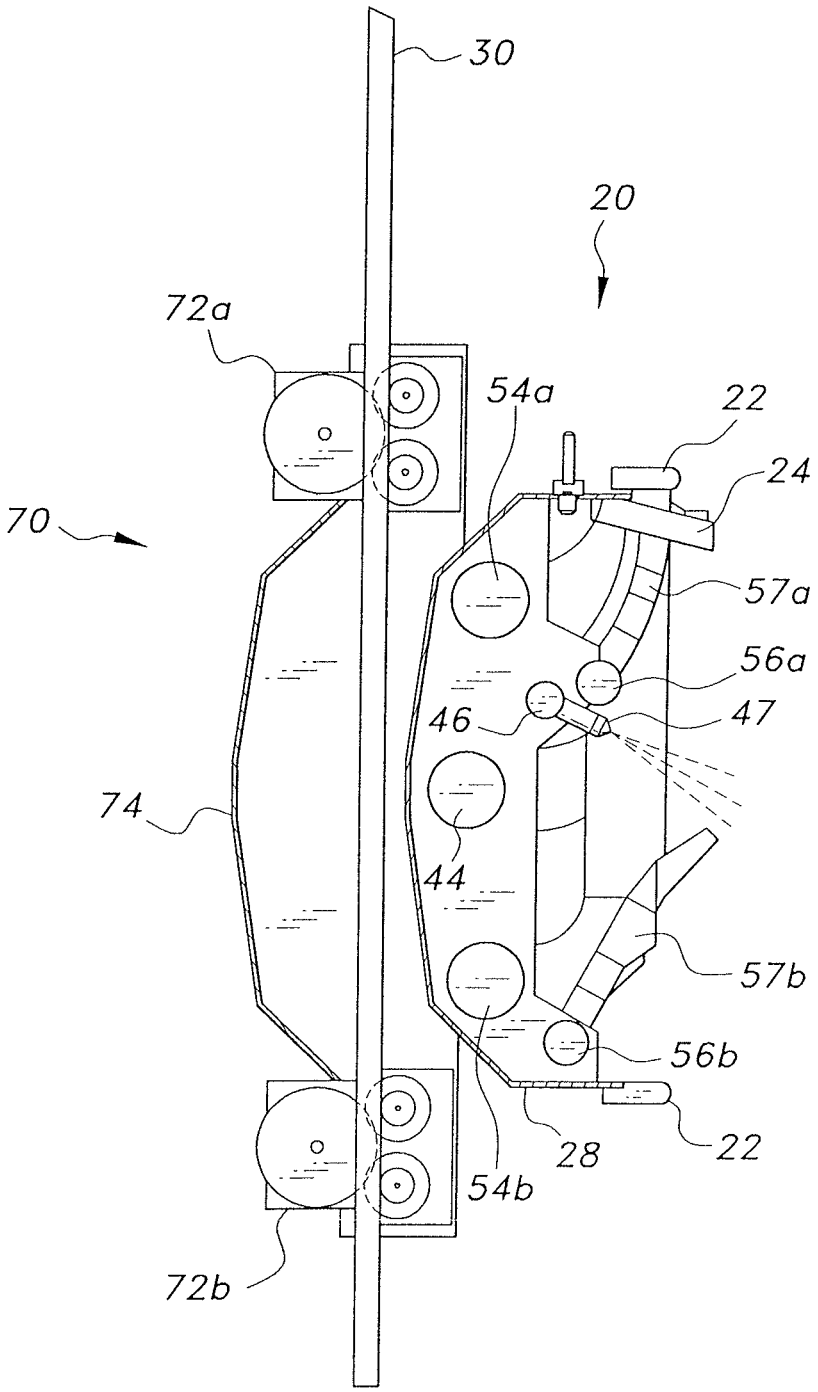
FIG. 5 is a sectional view of an embodiment of the cleaning module and cable guide of FIG. 1 taken through a guide cable.

FIG. 5 shows a cross-section of an embodiment of the cleaning module 20 and a cable guide 70 connecting the cleaning module 20 to the respective guide cable 30. Each cable guide 70 may include an upper roller 72*a* and a lower roller 72*b*, The upper and lower rollers 72*a*, 72*b* may be connected to the cleaning module 20, and each other, by a connection member 74. The connection member 74 may connect to a body 28 of the cleaning module 20.

The upper and lower rollers 72*a*, 72*b* may secure the cleaning module 20 to the guide cables 30 while allowing the cleaning module 20 to move along a length of the guide cables 30 with minimal resistance, One or both of the rollers may include an emergency brake (as known in the art) to prevent the rollers 72*a*, 72*b* from spinning when, for example, a malfunction occurs and a rotational rate of the rollers 72*a*, 72*b* exceeds a preset threshold.

In use, the cleaning module 20 may be lowered to a bottom of the building. Once at the bottom of the building, the fluid supply module 40 may begin supplying fluid through the fluid line 43 and the suction module 50 may begin providing suction through the suction line 53 to begin the cleaning process. The cleaning module 20 may clean the building façade as it is lifted up the face of the building by the hoists 60. While being lifted, the brush 24 may contact the facade to loosen dust and dirt that will then be sucked into the upper suction mouths 57*a*. After the loose dirt and dust is removed, pressurized heated water or steam may be sprayed at the façade from the nozzles 47 to remove dust and dirt that was not removed by the brush. In some embodiments, cleaning solution may be mixed with the heated water or steam. The lower suction mouths 57*b* may then suck in any water or dirt that is thrown off the facade by pressurized fluid expelled from nozzles 47.

In some embodiments, the hoist 60, fluid supply module 40, and suction module 50 may be controlled by a controller connected to a computing device. In some embodiments, the process may be fully automated and set to clean at specified times. In alternate embodiments, the controller may be partially automated by including a control panel that may be operated by a user. The control panel may allow for the hoists 60, fluid supply module 40, and suction module 50 to be individually controlled. In some embodiments, the controller may also control the emergency brake in the cable guides 70.

It is to be understood that the building façade cleaner is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. An automated building façade cleaner, comprising:

an elongated cleaning module having a predetermined length including:

a plurality of distinct and separate upper suction mouths extending along the predetermined length of the cleaning module, wherein each of the upper suction mouths are configured to taper from its upper end to its lower end, a plurality of distinct and separate lower suction mouths extending along the predetermined length of the cleaning module, wherein each of the lower suction mouths are configured to taper from its upper end to its lower end, a plurality of distinct and separate spray nozzles positioned between each of the upper suction mouths and each of the lower suction mouths, and a brush positioned above each of the upper suction mouths, the brush extending across the predetermined length of the cleaning module;

a nozzle conduit extending across the predetermined length of the cleaning module, the plurality of spray nozzles being spaced apart along the length of the nozzle conduit; and a primary fluid conduit extending across the length of the nozzle conduit;

wherein the primary fluid conduit is configured to direct fluid from the fluid line into the nozzle conduit;

an upper mouth conduit extending across the predetermined length of the cleaning module, wherein the upper mouth conduit is connected to each of the upper suction mouths via a connector conduit, the connector conduit being in fluid communication with each of the lower ends of the tapered upper suction mouths and the upper mouth conduit;

a lower mouth conduit spaced from the upper mouth conduit and extending across the predetermined length of the cleaning module, wherein the lower mouth conduit is connected to each of the lower suction mouths via a connector conduit, the connector conduit being in fluid communication with each of the lower ends of the tapered lower suction mouths and the lower mouth conduit;

an upper suction conduit extending across the length of the upper mouth conduit; and a lower suction conduit extending across the length of the lower mouth conduit;

wherein the upper suction conduit is configured to provide suction to the building façade through the upper mouth conduit; and wherein the lower suction conduit is configured to provide suction to the building façade through the lower mouth conduit;

a fluid supply module comprising a fluid tank and a fluid line;

a suction module comprising a vacuum pump, a suction line and a collection tank;

the fluid line having a first end in fluid communication with the nozzle conduit and an opposite second end in fluid communication with the fluid supply module;

the suction line having a first end in fluid communication with the upper and lower suction conduits, and a second end in fluid communication with the suction module;

at least one hoist configured to raise and lower the cleaning module; and two guide cables connected to and extending between the cleaning module and the at least one hoist.

2. The automated building façade cleaner of claim 1, wherein the primary fluid conduit has a larger diameter than the nozzle conduit.

3. The automated building façade cleaner of claim 1, wherein the upper suction conduit has a larger diameter than the upper mouth conduit and the lower suction conduit has a larger diameter than the lower mouth conduit.

4. The automated building façade cleaner of claim 1, further comprising two cable guides, each cable guide attaching the cleaning module to a respective guide cable, the cable guides each including a roller engaged with their respective guide cable.

* * * * *